United States Patent [19]

Zorev et al.

[11] 4,212,668

[45] Jul. 15, 1980

[54] STEEL FOR ATOMIC REACTOR VESSELS

[76] Inventors: Nikolai N. Zorev, ulitsa Novinki, 6, kv. 23, Moscow; Vladimir A. Tsykanov, ulitsa Angarskaya, 9, kv. 1, Dimitrovgrad Ulyanovskoi oblasti; Igor V. Gorynin, ulitsa Gromova, 16, kv. 50; Lev V. Tupitsyn, ulitsa I Maya, 27/44, kv. 9, both of Leningrad; Georgy P. Fedortsov-Lutikov, ulitsa Zhigulevskaya, 30, kv. 34, Moscow; Anatoly A. Astafiev, ulitsa Sharikopodshipnikovskaya, 2, kv. 34, Moscow; Vladimir S. Dub, ulitsa Festivalnaya, 14, korpus 3, kv. 372, Moscow; Oleg M. Vishkarev, ulitsa Sakhalinskaya, 4, kv. 72, Moscow; Alexandr S. Loboda, Otkrytoe shosse, 6, korpus 3, kv. 48, Moscow; Iraida I. Kalugina, Simonovsky val, 19, kv. 56, Moscow; Nikolai N. Kobelev, ulitsa Azovskaya, 25/22, kv. 16, Moscow; Valentin V. Krasinsky, ulitsa Izumrudnaya, 8, kv. 51, Moscow; Valery A. Litvak, Kolpino, Sovetsky bulvar, 27, kv. 8, Leningrad; Evgeny F. Davydov, prospekt Lenina, 30a, kv. 64; Valentin K. Shamardin, ulitsa Teatralnaya, 4b, kv. 4, both of Dimitrovgrad Ulyanovskoi oblasti; Jury F. Balandin, ulitsa Basseinaya, 117, korpus 1, kv. 35, Leningrad; Vladimir A. Nikolaev, ulitsa Radischeva, 14, kv. 16, Gatchina Leningradskoi oblasti; Jury V. Sobolev, prospekt Lenina, 30/9, kv. 10; Anatoly M. Parshin, prospekt Annikova, 11-1, kv. 43, both of Leningrad; Vladimir I. Badanin, ulitsa Gagarina, 12, kv. 21, Gatchina Leningradskoi oblasti, all of U.S.S.R.

[21] Appl. No.: 927,501

[22] Filed: Jul. 24, 1978

[51] Int. Cl.[2] ..... C22C 38/42

[52] U.S. Cl. ..... 75/125; 75/128 R; 75/128 V; 75/128 W; 176/88

[58] Field of Search ..... 75/125, 128 R, 128 V, 75/128 W; 176/88; 148/36

[56] References Cited

U.S. PATENT DOCUMENTS 4,072,509 2/1978 Zorev et al. ..... 75/128 V

OTHER PUBLICATIONS

Potapovs et al., "The Effect of Residual Elements on the Response of Selected Pressure-Vessel Steels and Weldments to Irradiation at 550° F.", Nuc. App., vol. 6, 1/1969, pp. 27–46.

Hawthorne, "Demonstration of Improved Radiation Embrittlement Resistance of A533-B Steel Through Control of Selected Residual Elements," 5/70, NRL Rept. 7121, pp. 1–30.

*Primary Examiner*—Arthur J. Steiner

*Attorney, Agent, or Firm*—Lackenbach, Lilling & Siegel

[57] ABSTRACT

A steel containing in percent by weight:

| | |
|---|---|
| carbon | from 0.13 to 0.8 |
| silicon | from 0.15 to 0.3 |
| manganese | from 0.3 to 0.6 |
| chromium | from 1.6 to 2.5 |
| nickel | from 1.0 to 2.0 |
| molybdenum | from 0.5 to 0.7 |
| vanadium | from 0.01 to 0.12 |
| copper | from 0.01 to 0.05 |
| antimony | from 0.0005 to 0.009 |
| tin | from 0.0005 to 0.009 |
| phosphorus | from 0.001 to 0.005 |
| arsenic | from 0.0005 to 0.002 |
| iron, the balance, | |

the total amount of phosphorus and arsenic contained in said composition is expressed by the following relationship:

$$P+5As \leqq 1.10^{-2} \text{ wt.\%}.$$

1 Claim, No Drawings

STEEL FOR ATOMIC REACTOR VESSELS

BACKGROUND OF THE INVENTION

1. Field of the Invention

The present invention relates to radiation-resistant steels used for manufacturing vessels of water-cooled power reactors, and may be utilized for other installations whose construction material is exposed to neutron radiation during the course of operation.

The invention is readily adapted for application in the manufacture of vessels for high-power water-cooled reactors.

2. Description of the Prior Art

The prior art teaches steels formerly used in the production of atomic reactors, or those specifically developed for pressure vessels such as boiler shells, steam-generator drums, etc., which show resistance to radiation when exposed thereto under operating conditions. However, it has been revealed in the course of prolonged operation that with the exposure dose effecting said steels being in excess of $2.0.10^{19}$N/cm$^2$ (exposure temperature being 290° C.), the material of reactor vessels becomes prone to embrittlement. This, in turn, substantially reduces the impact strength of said material and increases the fracture transition temperature thereof. As a result, the operating reliability and durability of atomic reactors are greatly impaired.

There is also known in the art a steel employed for similar purposes, having the following composition, in percent by weight: carbon, from 0.06 to 0.15; manganese, 0.15 to 0.4, silicon, 0.16 to 1; nickel, 2.5 to 8; molybdenum, 0.25 to 1.25; chromium, 0.5 to 0.9 phosphorus, of up to 0.015, sulfur, of up to 0.015, aluminum, of up to 0.08; nitrogen, of up to 0.006; oxygen, of up to 0.004; iron, the balance.

However, the aforesaid steel is only applicable when the exposure dose does not exceed $4.10^{\cdot}$N/cm$^2$ ($E \geqq 0.5$ MeV).

Featuring the highest characteristics is a steel of the following composition, in percent by weight:

| | |
|---|---|
| carbon | from 0.13 to 0.18 |
| manganese | from 0.3 to 0.6 |
| silicon | from 0.15 to 0.3 |
| nickel | from 1.0 to 1.6 |
| chromium | from 1.6 to 2.5 |
| molybdenum | from 0.5 to 0.7 |
| vanadium | from 0.01 to 0.12 |
| cerium | from 0.002 to 0.04 |
| copper | from 0.01 to 0.1 |
| antimony | from 0.0005 to 0.009 |
| tin | from 0.0005 to 0.009 |
| phosphorus | from 0.002 to 0.01 |
| sulfur | from 0.001 to 0.01 |
| iron, | the balance |

Contained in said steel as an admixture, is arsenic in an amount of 0.004 to 0.02 percent by weight. The steel of the above-mentioned composition can be used with the exposure dose being $1.10^{20}$ N/cm$^3$ ($E \geqq 0.5$ MeV), at a temperature of 300° to 350° C.

The disadvantage of the steel referred to above is its susceptability to embrittlement when exposed to radiation.

BRIEF DESCRIPTION OF THE INVENTION

The primary object of the present invention is to provide a steel featuring enhanced exposure resistance, the application of which will enable safety operation of high-power water-cooled reactors for power stations, with the reactor vessels being operable at a temperature of 250° to 350° C. and exposure of $2.10^{20}$ N/cm$^2$ ($E \geqq 0.5$ MeV).

Another important object of the invention is to provide a steel for use in the manufacture of water-cooled power reactors with a view to substantially increasing their service life.

Still another object of the invention is to improve radiation-resistance properties of welded joints as compared to those of the prior-art steel welded joints used for similar purposes.

These and other objects of the invention are accomplished by the provision of a steel having the following composition: iron; carbon; silicon; manganese; chromium; nickel, molybdenum; vanadium; copper; antimony; tin; phosphorus; arsenic, wherein, according to the invention, said ingredients are contained in the following amounts:

| | Percent by weight of the total weight of the composition |
|---|---|
| carbon | from 0.13 to 0.18 |
| silicon | from 0.15 to 0.3 |
| manganese | from 0.3 to 0.6 |
| chromium | from 1.6 to 2.5 |
| nickel | from 1.0 to 2.0 |
| molybdenum | from 0.5 to 0.7 |
| vanadium | from 0.01 to 0.12 |
| copper | from 0.01 to 0.05 |
| antimony | from 0.0005 to 0.009 |
| tin | from 0.0005 to 0.009 |
| phosphorus | from 0.001 to 0.005 |
| arsenic | from 0.0005 to 0.002 |
| iron, | the balance; |

the total amount of phosphorus and arsenic contained in said composition is expressed by the following relationship:

$$P+5As \leqq 1.10^{-2} \text{wt.\%}.$$

A chromium content in an amount of from 1.6 to 2.5 percent by weight, in the steel, improves its hardenability, ensures uniformity of strength and ductility properties, increases impact toughness and lowers fracture transition temperature. With a chromium content of less than 1.6 percent by weight, in the steel, the required mechanical properties of steel are impossible to achieve; specifically with regard to strength characteristics and low critical temperature of brittleness. An increase in chromium content above 2.5 wt.% is undesirable as this may result in the formation of complicated carbides and, consequently, in lower values of impact toughness.

A chromium-nickel-molybdenum combination makes it possible to appreciably increase strength values of steel. Therefore, added into the proposed steel alongside with chromium is nickel in an amount of 1.0 to 2.0 percent by weight, and molybdenum in an amount of 0.5 to 0.7 percent by weight.

The above-mentioned carbon content in steel in an amount of from 0.13 to 0.18 percent by weight enables the production of steel featuring increased strength without lowering critical temperature of brittleness or impairing working properties of forgings with a thickness of up 650 mm.

Silicon content in steel within the range referred to above allows for its complete deoxidation and the production of solid steel ingots. An increase of silicon content above 0.3 percent by weight, in the steel, may result in the formation of nonmetallic inclusions which adversely affect its impact toughness.

A vanadium content in an amount of 0.01 to 0.12 percent by weight, in the steel, ensures fine-grained structure of steel, which increases its impact toughness and lowers fracture transition temperature.

An arsenic content in an amount of 0.0005 to 0.002 percent by weight and that of phosphorus in an amount of 0.001 to 0.005 percent by weight, with copper content therein ranging from 0.01 to 0.05 percent by weight, in the steel, ensures high resistance of steel to radiation and provides for high processing properties and service characteristics.

The total amount of phosphorus and arsenic contained in the steel of the invention is expressed by the following relationship.

$$P+5As \leqq 1.10^{-2} wt.\%.$$

The main component of steel is iron. In addition to the above-mentioned ingredients, contained in the hereinproposed steel are the following additions, in percent by weight.

| | |
|---|---|
| sulfur | of up to 0.010 |
| antimony | of up to 0.009 |
| tin | of up to 0.009 |

The steel of the invention is produced in electric arc and open-hearth furnaces by conventional melting processes wherein use is made of adequately treated charge materials. Deoxidation of steel is effected by means of materials commonly used in metallurgical practice.

Given herein below is a table used as an exemplary illustration of chemical compositions of the proposed steel containing four examples. The first three examples refer to the proposed invention, while the fourth one is given for the sake of comparison, illustrating chemical composition of the prior-art steel. Indicated in the table are also changes in steel properties due to the proposed variations in its chemical composition.

Chemical Composition and Resistance of Steels Exposed to Radiation at a Temperature of 250° to 290° C. With Exposure Dose of $2.10^{20}$ n/cm$^2$ (E≧0.5 Mev).

| | Composition, wt, % | | | | | | | | | |
|---|---|---|---|---|---|---|---|---|---|---|
| | C | Si | Mn | Cr | Ni | Mo | V | Al | P | As |
| 1 | 0.18 | 0.22 | 0.41 | 1.96 | 1.48 | 0.7 | 0.01 | 0.028 | 0.003 | 0.0004 |
| 2 | 0.18 | 0.15 | 0.41 | 2.0 | 1.42 | 0.7 | 0.01 | 0.11 | 0.003 | 0.0007 |
| 3 | 0.15 | 0.35 | 0.47 | 1.97 | 1.14 | 0.62 | 0.10 | 0.04 | 0.003 | 0.0013 |
| 4 | 0.17 | 0.26 | 0.45 | 1.74 | 1.35 | 0.57 | 0.10 | 0.01 | 0.01 | 0.0041 |

| Cu | Sn | Sb | P+ | Fracture transition temperature, °C. prior to exposure | after exposure | Changes in fraction transition temperature, °C. |
|---|---|---|---|---|---|---|
| 0.02 | 0.002 | 0.00090 | $5 \cdot 10^{-3}$ | −80 | −80 | 0 |
| 0.2 | 0.001 | 0.0007 | $0.7 \cdot 10^{-2}$ | −85 | −75 | 10 |
| 0.02 | 0.001 | 0.0010 | $1.0 \cdot 10^{-2}$ | −60 | −30 | 30 |
| 0.12 | 0.001 | 0.002 | $3 \cdot 10^{-2}$ | −70 | +20 | 90 |

What is claimed is:

1. A steel for atomic reactor vessels, said steel consisting essentially of, in weight percent,

| | |
|---|---|
| carbon | from 0.13 to 0.18 |
| silicon | from 0.15 to 0.30 |
| manganese | from 0.30 to 0.60 |
| chromium | from 1.6 to 2.5 |
| nickel | from 1.0 to 2.0 |
| molybdenum | from 0.5 to 0.7 |
| vanadium | from 0.01 to 0.12 |
| copper | from 0.01 to 0.05 |
| antimony | from 0.0005 to 0.009 |
| tin | from 0.0005 to 0.009 |
| phosphorus | from 0.001 to 0.005 |
| arsenic | from 0.0005 to 0.002 |
| iron, | the balance, |

the total amount of phosphorus and arsenic contained in said composition is expressed by the following relationship:

$$P+5As \geqq 1.10^{-2} wt.\%.$$

* * * * *